US009520686B2

(12) United States Patent
Hu et al.

(10) Patent No.: US 9,520,686 B2
(45) Date of Patent: Dec. 13, 2016

(54) ELECTRICAL CONNECTOR HAVING DETECTING CONTACT

(71) Applicant: FOXCONN INTERCONNECT TECHNOLOGY LIMITED, Grand Cayman (KY)

(72) Inventors: Jian-Long Hu, Kunshan (CN); Li Dong, Kunshan (CN); Shu-Jian Wang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/979,570

(22) Filed: Dec. 28, 2015

(65) Prior Publication Data

US 2016/0181745 A1 Jun. 23, 2016

(30) Foreign Application Priority Data

Dec. 22, 2014 (CN) ..... 2014 2 0811503 U

(51) Int. Cl.
*H01R 13/641* (2006.01)
*H01R 24/60* (2011.01)
*H01R 107/00* (2006.01)

(52) U.S. Cl.
CPC ..... *H01R 24/60* (2013.01); *H01R 2107/00* (2013.01)

(58) Field of Classification Search
CPC ..... H01R 13/641
USPC ..... 439/188, 489
See application file for complete search history.

(56) References Cited

U.S. PATENT DOCUMENTS

| | | | | |
|---|---|---|---|---|
| 7,572,146 | B1 * | 8/2009 | Chiang | H01R 12/712 439/607.01 |
| 7,798,832 | B2 * | 9/2010 | Qin | H01R 12/712 439/188 |
| 8,206,174 | B2 * | 6/2012 | Ko | H01R 13/703 439/489 |
| 8,398,416 | B2 * | 3/2013 | Tseng | H01R 13/6658 439/188 |
| 8,475,202 | B1 * | 7/2013 | Chiang | H01R 13/6582 439/489 |
| 8,690,608 | B2 * | 4/2014 | Naito | H01R 13/7039 439/607.01 |

(Continued)

FOREIGN PATENT DOCUMENTS

| | | |
|---|---|---|
| CN | 102842828 | 12/2012 |
| CN | 103427236 | 12/2013 |
| TW | M458711 | 8/2013 |

*Primary Examiner* — Neil Abrams
(74) *Attorney, Agent, or Firm* — We Te Chung; Ming Chieh Chang

(57) ABSTRACT

An electrical connector includes an insulating housing, a plurality of conductive terminals, a detecting contact and a metallic shell. The insulating housing has a base portion extending along a longitudinal direction and a mating tongue extending forwardly from the base portion. The mating tongue has a receiving slot recessed therefrom in which the detecting contact received. The metallic shell surrounds the insulating housing to form a receiving room. The detecting contact defines a detecting section extending out of the receiving slot for protruding into the receiving room. The insulating housing defines a supporting block formed in the receiving slot for supporting the detecting contact to prevent the detecting contact from over-skewing.

20 Claims, 5 Drawing Sheets

(56) References Cited

U.S. PATENT DOCUMENTS

| | | | | |
|---|---|---|---|---|
| 8,747,147 | B2 * | 6/2014 | Yu | H01R 13/7031 439/108 |
| 8,814,583 | B2 * | 8/2014 | Naito | H01R 24/60 439/188 |
| 8,956,179 | B2 * | 2/2015 | MacDougall | H01R 13/641 439/489 |
| 8,974,240 | B2 * | 3/2015 | Yu | H01R 29/00 439/188 |
| 9,065,219 | B2 * | 6/2015 | Naito | H01R 13/7033 |
| 9,318,854 | B2 * | 4/2016 | Chang | H01R 13/6581 |
| 9,325,123 | B2 * | 4/2016 | Yu | H01R 13/641 |
| 9,368,922 | B2 * | 6/2016 | Yen | H01R 13/6582 |
| 2013/0210251 | A1 * | 8/2013 | Little | H01R 13/7036 439/188 |
| 2013/0316592 | A1 * | 11/2013 | Yu | H01R 13/516 439/660 |
| 2014/0051303 | A1 * | 2/2014 | Yu | H01R 13/46 439/660 |

* cited by examiner

ELECTRICAL CONNECTOR HAVING DETECTING CONTACT

BACKGROUND OF THE INVENTION

1. Field of the Invention

The present invention generally relates to an electrical connector, and more particularly to an electrical connector having a detecting contact secured therein.

2. Description of Related Art

TW patent issued NO. M458711 discloses an electrical connector, the electrical connector has an insulating housing, a plurality of conductive terminals received in the insulating housing and a metallic shell surrounding the insulating housing. The insulating housing has a base portion and a mating portion extending forwardly. The electrical connector has a detecting contact having a retaining portion retained in the insulating housing, an extending portion extending forwardly from the retaining portion and a contacting portion further extending forwardly from the extending portion. The contacting portion of the detecting contact is used for contacting with a metallic shell of a USB PD (power delivery, may transmit large electric current) plug so as to obtain recognition. However, the extending portion may loose elasticity after being frequently used, which may cause the contacting portion of the detecting contact move forwardly, thereby a metallic shell of the non-USB PD plug may contact with the contacting portion of the detecting contact when the non-USB PD plug is inserted. As a result, the system of the electrical connector allows large electric current pass due to regard the non-USB PD plug as the USB PD plug. The large power may destroy electrical elements of the electrical connector and the non-USB PD plug.

Therefore, an electrical connector having a protruding block is provided to overcome the drawbacks described aforementioned would be desirable.

SUMMARY OF THE INVENTION

Accordingly, an object of the present invention is to provide an electrical connector having a supporting block for supporting a detecting contact so as to prevent the detecting contact from over-skewing.

In order to achieve the object set forth, an electrical connector has an insulating housing, a plurality of conductive terminals received in the insulating housing, a detecting contact and a metallic shell. The insulating housing has a base portion extending along a longitudinal direction and a mating tongue extending forwardly from the base portion. The conductive terminals provide contacting sections exposed upon the mating tongue. The mating tongue has a receiving slot recessed therefrom in which the detecting contact received. The metallic shell surrounds the insulating housing to form a receiving room for receiving the mating tongue therein. The detecting contact defines a detecting section extending out of the receiving slot for protruding into the receiving room. The insulating housing defines a supporting block formed in the receiving slot for supporting the detecting contact to prevent the detecting contact from over-skewing.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
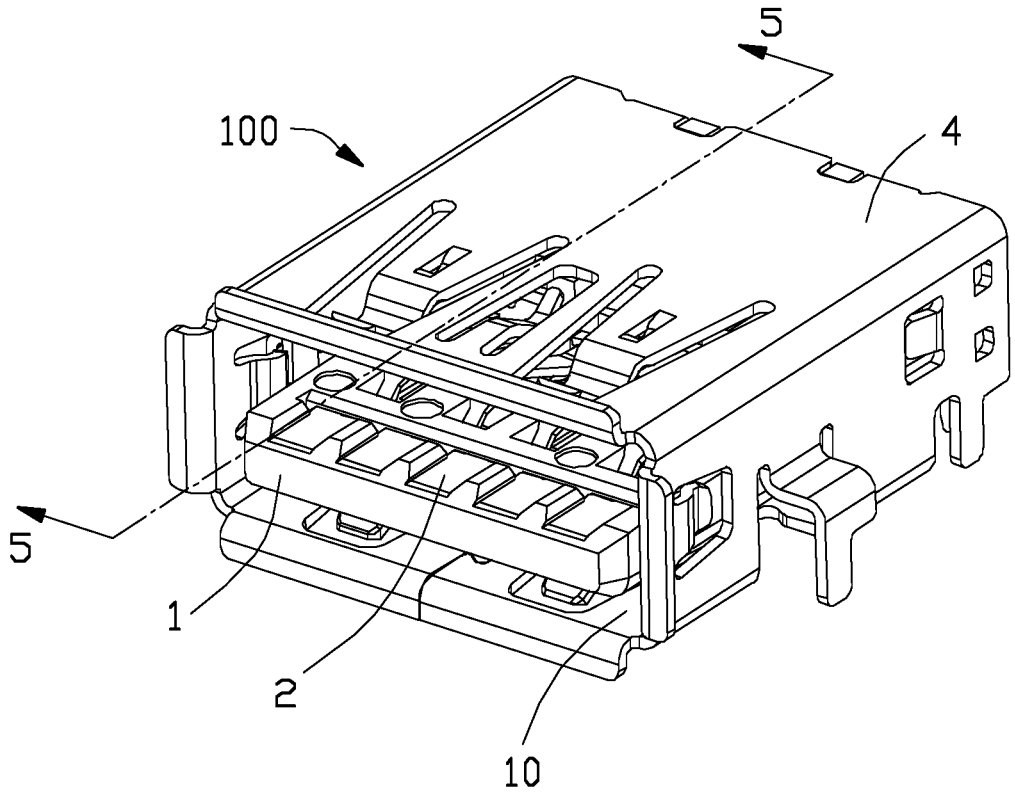
FIG. 1 is a perspective view of an electrical connector of the present invention.
Figure 2:
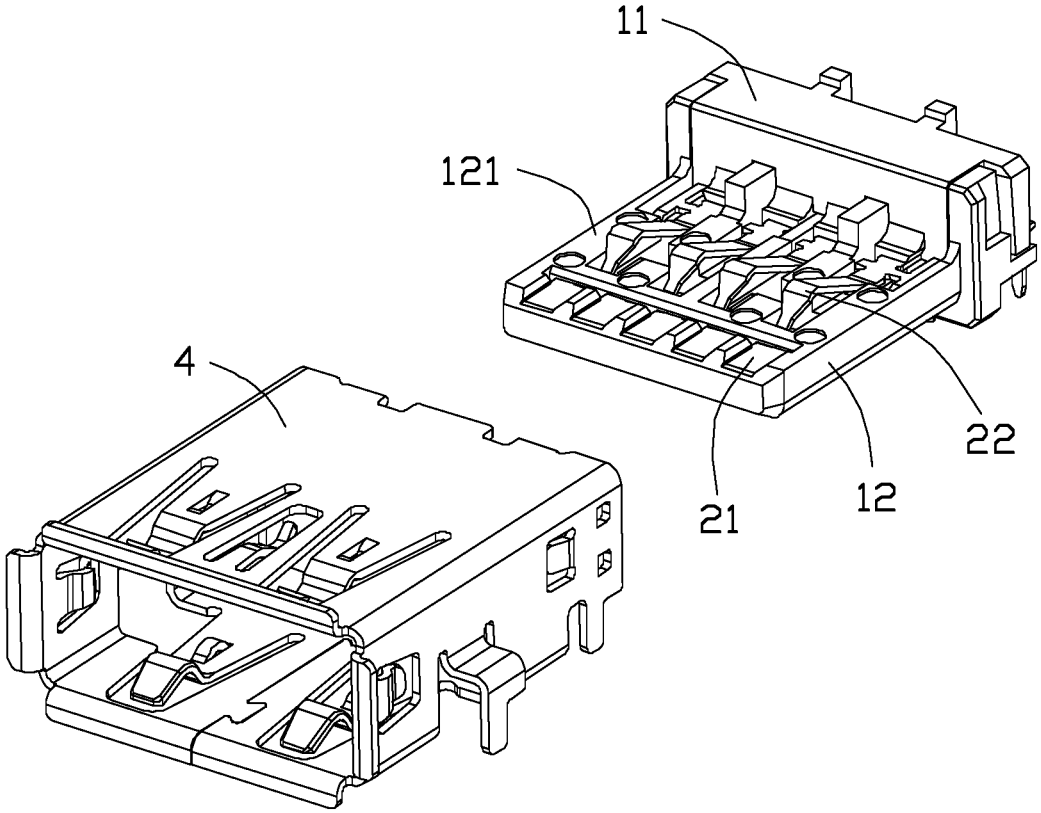
FIG. 2 is a part exploded perspective view of the electrical connector shown in FIG. 1.
Figure 3:
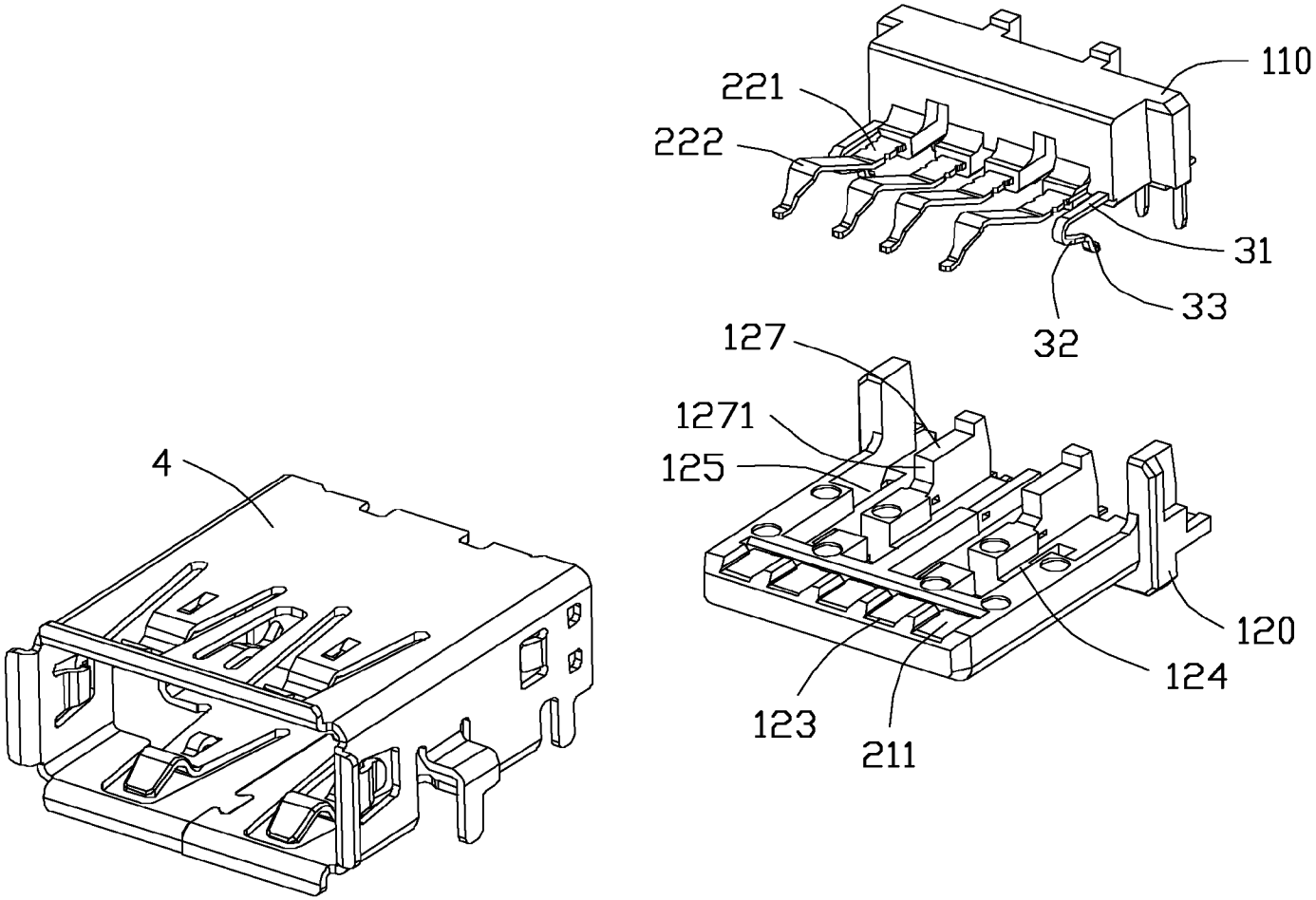
FIG. 3 is a part exploded perspective view of the electrical connector shown in FIG. 1, two terminal modules are apart from each other.

Referring to FIG. 1 to FIG. 3, the present invention provides an electrical connector 100 for transmitting data signal. The electrical connector 100 has an insulating housing 1, a plurality of conductive terminals 2 received in the insulating housing 1, a pair of detecting contacts 3 retained in the insulating housing 1 and a metallic shell 4 surrounding the insulating housing 1. The metallic shell 4 surrounds the insulating housing 1 to form a receiving room 10. The electrical connector 100 of the present invention is a USB 3.0 PD (power delivery, may transmit large electric current) receptacle connector for selectively mating with a standard USB plug connector and a USB PD plug connector.

Referring to FIG. 1 to FIG. 4, the insulating housing 1 has a base portion 11 extending along a longitudinal direction and a mating tongue 12 extending along a rear-to-front direction perpendicular to the longitudinal direction from the base portion 11. The mating tongue 12 has a first mating face 121 and a second mating face 122 opposite to the first mating face 121. The mating tongue 12 has a plurality of first receiving slots 123, a plurality of second receiving slots 124 and two third receiving slots 125. The first receiving shots 123 and the second receiving slots 124 are all recessed from the first mating face 121 of the mating tongue 12. The first receiving slots 123 are arranged in a front area of the mating tongue 12 along the longitudinal direction, and the second receiving slots 124 are arranged behind the first receiving slots 124. The plurality of conductive terminals 2 are received in the first and second receiving slots 123, 124. The two third receiving slots 125 are respectively disposed at two sides of the mating tongue 12 along the longitudinal direction. The two third receiving slots 125 both run through the first mating face 121 and the second mating face 122 in which the two detecting contacts 3 are separately disposed. The two third receiving slots 125 may only run through the second mating face in other preferred embodiments. Combined with FIG. 5, the insulating housing 1 further defines a supporting block 126 protruding into each third receiving slot 125. The supporting block 126 extends backwardly and downwardly from a front inner surface of the third receiving slot 125. The supporting block 126 has an inclined supporting face 1260 for supporting the detecting contact 3. The mating tongue 12 has at least a stopping block 127 protruding upwardly from a rear area of the first mating face 121 thereof for stopping a non-USB PD plug connector from further inserting. There are two stopping blocks 127 protruding into the receiving room 10 in the present invention. Each of the stopping blocks 127 is disposed between two neighbored second receiving slots 124. The stopping block 127 has a stopping face 1271 in a front side and perpendicular to the first mating face 121 of the mating tongue 12. The distance between the stopping face 1271 and a front face of the mating tongue 12 is equal to the length of a mating tongue of the standard USB plug. A gap is formed between a top face of the stopping block 127 and the metallic shell 4 for allowing a shell of the USB PD plug connector passing through. The insulating housing 1 is formed with a first insulator 120 and a second insulator 110 assembled to the first insulator 120 along a top-to-bottom direction perpendicular to the longitudinal direction and the rear-to-front direction. The first insulator 120 forms the mating tongue 12, the stopping block 127 protrudes from the first insulator 120. The second insulator 110 forms the base portion 11 and is stopped by the stopping block 127 in the rear-to-front direction when the first insulator 120 and the second insulator 110 are assembled.

Figure 4:
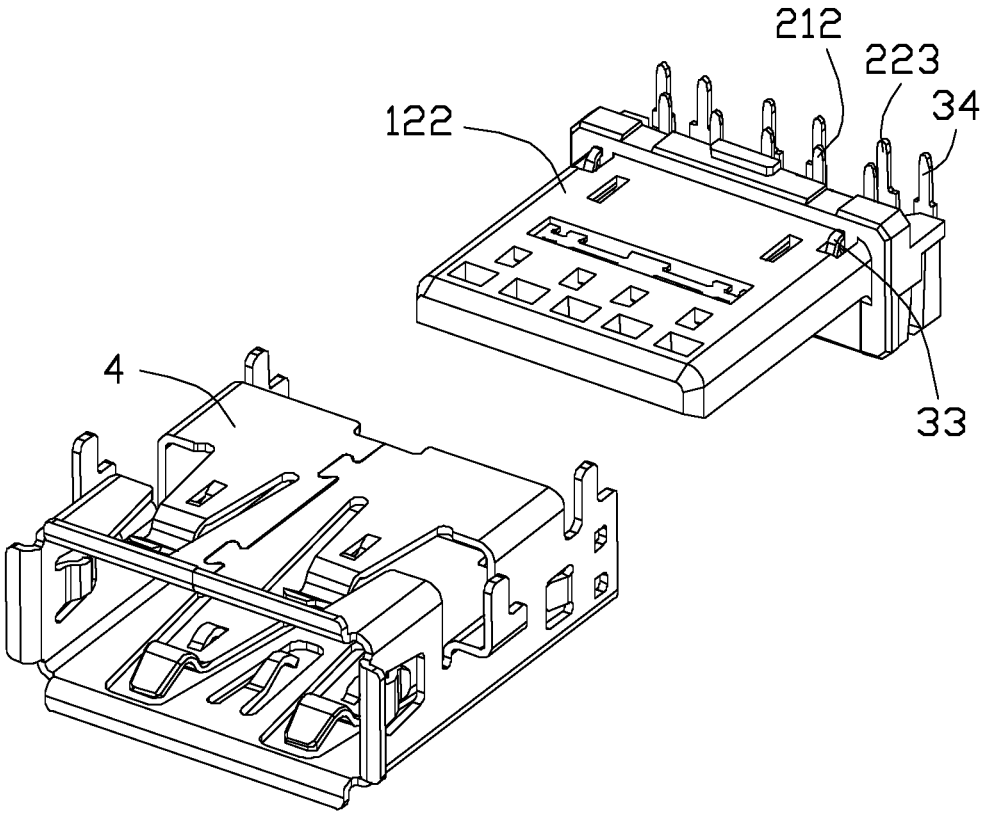
FIG. 4 is another perspective view of the electrical connector shown in FIG. 2.

Referring to FIG. 3 and FIG. 4, the plurality of conductive terminals 2 are divided into five first terminals 21 and four second terminals 22. The first terminals 21 are stamped by one metal plate and embedded in the first insulator 120 to commonly form a first terminal module. The second terminal 22 are insert-molded within the second insulator 110 to commonly form a second terminal module. The carrier is cut off after the first terminals 21 are insert molded with the first insulator 120. Each first terminal 21 has a first retaining section (not labeled) received in the mating tongue 12, a flat first contacting section 211 extending forwardly from the first retaining section and exposed in the first receiving slot 123 and a first soldering section 212 extending downwardly from an end of the first retaining section. Each second terminal 22 has a second retaining section (not labeled) received in the second insulator 110, a second connecting section 221 extending forwardly from a front end of the second retaining section, an elastic second contacting section 222 further extending forwardly from the second connecting section 221 and received in the second receiving slot 124 and a second soldering section 223 extending downwardly beyond the insulating housing 1 from a rear end of the second retaining section. The first contacting sections 211 and the second contacting sections 222 are all disposed onto the first face of the mating tongue 12. The first soldering sections 223 and the second soldering sections 212 are arranged at two rows at an interval along the rear-to-front direction.

Figure 5:
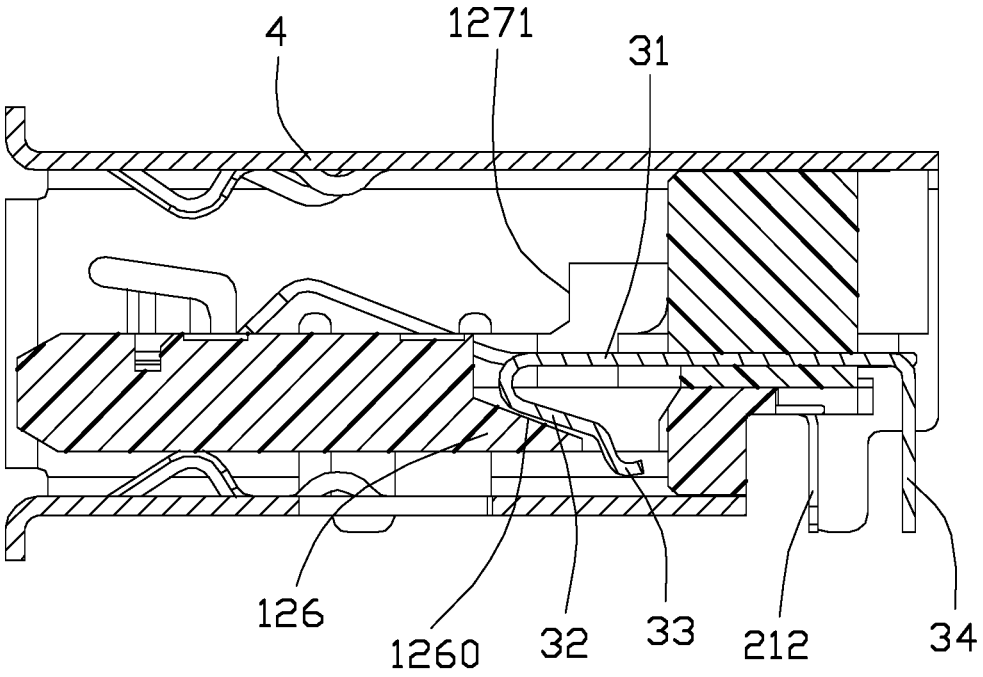
FIG. 5 is a sectional perspective view of the electrical connector along line 5-5 shown in FIG. 1.

Referring to FIG. 3 to FIG. 5, the pair of detecting contacts 3 are separately received in the two sides of the insulating housing 1 and disposed at two sides of the plurality of second terminals 22. The detecting contacts 3 and the second terminals 22 are stamped by one metal plate and commonly embedded in the insulating housing 1. The detecting contact 3 has a third retaining section (not labeled) received in the base portion 11, a third connecting section 31 extending forwardly from a front end of the retaining section and received in the third receiving slot 125, a backward extending section 32 bending from a front end of the third connecting section 31 and then extending downwardly and inclined, a detecting section 33 extending downwardly beyond the second mating face 122 of the mating tongue 12 into the receiving room 10, and a third soldering section 34 extending downwardly beyond the insulating housing 1 from the third retaining section. The third connecting sections 31 of the detecting contacts 3 and the second connecting sections 221 of the second terminals 2 are connected with each other before carrier is cutoff. The two third soldering sections 34 of the two detecting contacts 3 and the plurality of the second soldering sections 223 of the second terminals 22 are arranged in one row, and the two third soldering sections 34 are disposed at two sides of the plurality of second soldering sections 223. The extending section 32 is located above the supporting block 126 and roughly parallel to the supporting face 1260. The detecting section 33 is located behind the stopping face 1271 of the stopping block 127 along a mating direction. The mating direction is just the rear-to-front direction. When the electrical connector 100 mates with a USB PD plug connector, the shell of the USB PD plug is longer than the mating tongue thereof, a front end of the shell of the USB PD plug extending forwardly beyond a front end of the mating tongue of the USB PD plug, thereby the mating tongue may be stopped by the stopping face 1127, the shell may contact with the detecting section 33 of the detecting contact 3 by passing through the gap between the stopping block 127 and the metallic shell 4. When the electrical connector 100 mates with a standard USB plug connector, the mating tongue of the standard USB plug can't contact with or just contact with the stopping face 1271, and the standard USB plug will not contact with the detecting contact 3. However, size of some USB plug connectors are not standard, which has a longer shell than the standard USB plug connector. We called these USB connectors are non-standard USB plug connectors. When the non-standard USB plug connector mates with the electrical connector 100, a mating tongue of the non-standard USB plug connector may be stopped by the stopping face 1127 so as to prevent the non-standard USB plug connector from further inserting due to the longer mating tongue of the non-standard USB plug connector, thereby the non-standard USB plug connector can't contact with the detecting contact.

The third connecting section 31 of the detecting contact 3 is received in the third receiving slot 125. The insulating housing 1 has a supporting block 126 located below the extending portion 32 of the detecting contact 3. The elastic property of the extending section 32 of the detecting contact 3 is reducing due to repeated use so as to lead the extending section 32 moving forwardly. In the present invention, the extending section 32 of the detecting contact 3 resists on the supporting face 1260 of the supporting block 126 when the extending section 32 moving forwardly, which stops the extending section 32 from further moving forwardly, thereby the detecting section 33 of the detecting contact 3 may not over move forwardly to connect with the non-USB PD plug connector.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulating housing having a base portion extending along a longitudinal direction and a mating tongue extending forwardly from the base portion;

a plurality of conductive terminals received in the insulating housing and providing contacting sections exposed upon the mating tongue;

a detecting contact retained in the housing and disposed in a receiving slot recessed from the mating tongue; and a metallic shell surrounding the insulating housing to form a receiving room for receiving the mating tongue therein;

wherein the detecting contact defines a detecting section extending out of the receiving slot for protruding into the receiving room, and the insulating housing defines a supporting block formed in the receiving slot for supporting the detecting contact to prevent the detecting contact from over-skewing.

2. The electrical connector as claimed in claim 1, wherein the mating tongue has two said receiving slots recessed therefrom, the electrical connector has two said detecting contacts separately disposed in the two receiving slots.

3. The electrical connector as claimed in claim 1, wherein the detecting contact has a connecting section received in the receiving slot and an extending section bending backwardly from the connecting section, said detecting section extends downwardly into the receiving room from the extending section, and the supporting block is attached to the extending section for stopping the extending section from forwardly moving.

4. The electrical connector as claimed in claim 3, wherein the supporting block extending backwardly from a front wall of the receiving slot.

5. The electrical connector as claimed in claim 4, wherein the supporting block has an inclined supporting face, the supporting face is located below the extending section of the detecting contact.

6. The electrical connector as claimed in claim 5, wherein the supporting face is parallel to the extending section.

7. The electrical connector as claimed in claim 3, wherein the plurality of conductive terminals are divided into a front row of first terminals and a rear row of second terminals, each second terminal has a retaining section retained in the base and a connecting section extending forwardly from the retaining section, the connecting sections of the second terminals and the connecting sections of the detecting section mechanically connect before carrier is cutoff.

8. The electrical connector as claimed in claim 7, wherein the electrical connector has a stopping block protruding into the receiving room, the stopping block has a stopping face disposed at a front side thereof and perpendicular to the mating tongue, and the stopping face is located in front of the detecting section of the detecting contact along a rear-to-front direction perpendicular to the longitudinal direction.

9. The electrical connector as claimed in claim 8, wherein the insulating housing has a first insulator and a second insulator assembled to the first insulator along a top-to-bottom direction perpendicular to the longitudinal direction and the rear-to-front direction, the first terminals are embedded in the first insulator, the second terminals and the detecting contacts are embedded in the second insulator.

10. The electrical connector as claimed in claim 9, wherein the first insulator forms the mating tongue, the stopping block protruding upwardly from the mating tongue.

11. The electrical connector as claimed in claim 10, wherein the stopping block stops the second insulator from forwardly moving.

12. An electrical connector comprising:

an insulating housing having a base portion extending along a longitudinal direction and a mating tongue extending forwardly from the base portion;

a metallic shell surrounding the insulating housing to form a mating cavity, and the mating tongue protruded in the mating cavity;

a plurality of conductive terminals retained in the insulating housing; and a detecting contact retained in the insulating housing and having an elastic contacting arm extending toward the mating cavity for exposing a contacting section in the mating cavity;

wherein the insulating housing has a supporting block for supporting the contacting arm so as to prevent the contacting section from forwardly moving.

13. The electrical connector as claimed in claim 12, wherein the electrical connector has two said detecting contacts retained in the insulating housing.

14. The electrical connector as claimed in claim 12, wherein the insulating housing has a receiving slot downwardly running through the mating tongue and in which the contacting arm is partly received, the supporting block is disposed in the receiving slot and extending backwardly from a front wall of the receiving slot.

15. The electrical connector as claimed in claim 14, wherein the insulating housing has a stopping block protruding into the mating cavity and located in a rear portion of the mating cavity, the stopping block has a stopping face facing outwardly, and the contacting section is located behind the stopping face along a rear-to-front direction perpendicular to the longitudinal direction.

16. An electrical connector comprising:

a first terminal module including a plurality of stationary contacts insert-molded within a first insulator;

a plurality of deflectable contacts insert-molded within a second insulator, a mating tongue formed by said second insulator and defining opposite first and second surfaces thereon;

the first insulator and the second insulator configured to be assembled to each other in a vertical direction;

the deflectable contacts including a plurality of mating contacts cooperating with the stationary contacts commonly exposed upon the first surface, and a plurality of detecting contacts exposed upon the second surface; and a metallic shell enclosing the assembled first terminal module and second terminal module; wherein a contacting section of the detecting contact is located behind a contacting section of the mating contact in a front-to-back direction perpendicular to said vertical direction; wherein the mating tongue forms a supporting block to protectively confronting the corresponding detecting contact in the vertical direction.

17. The electrical connector as claimed in claim 16, wherein the second surface is closer to the metallic shell than the first surface to the metallic shell in the vertical direction.

18. The electrical connector as claimed in claim 16, wherein the detecting contact includes a backwardly obliquely extending section protectively hidden behind the supporting block in both the vertical direction and the front-to-back direction.

19. The electrical connector as claimed in claim 16, wherein the first insulator further includes a stopping block opposite to the supporting block in the vertical direction with a forward stopping face, and said forward stopping face is located in front of the contacting section of the detecting contact in the front-to-back direction.

20. The electrical connector as claimed in claim 16, wherein a base portion is formed by both the first insulator and the second insulator and located behind the mating tongue to intimately abut against an interior of the metallic shell.

* * * * *